US009507308B2

(12) United States Patent
Kawabe

(10) Patent No.: US 9,507,308 B2
(45) Date of Patent: Nov. 29, 2016

(54) IMAGE FORMING APPARATUS AND METHOD OF IMAGE INSPECTION TO DETECT IMAGE DEFECT AND SHEET COLOR

(71) Applicant: Konica Minolta, Inc., Chiyoda-ku (JP)

(72) Inventor: Toru Kawabe, Hachioji (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 0 days.

(21) Appl. No.: 14/573,583

(22) Filed: Dec. 17, 2014

(65) Prior Publication Data

US 2015/0177664 A1 Jun. 25, 2015

(30) Foreign Application Priority Data

Dec. 24, 2013 (JP) ..... 2013-264778

(51) Int. Cl.
*G03G 15/00* (2006.01)

(52) U.S. Cl.
CPC ..... *G03G 15/5062* (2013.01)

(58) Field of Classification Search
CPC ..... G03G 15/5062; G03G 15/55; G03G 15/5025; G03G 15/5029; G03G 15/5041
USPC ..... 399/15
See application file for complete search history.

(56) References Cited

U.S. PATENT DOCUMENTS

2009/0217268 A1* 8/2009 Pandit ..... G06F 3/1288 718/100
2010/0123914 A1* 5/2010 Uwatoko ..... H04N 1/6094 358/1.9

FOREIGN PATENT DOCUMENTS

| | | | |
|---|---|---|---|
| JP | 2001189872 | A | 7/2001 |
| JP | 2005-205706 | A | 8/2005 |
| JP | 2007148027 | A | 6/2007 |
| JP | 2007-310567 | A | 11/2007 |
| JP | 2008-15025 | A | 1/2008 |
| JP | 2008061159 | A | 3/2008 |
| JP | 2010122870 | A | 6/2010 |
| JP | 2013255216 | A | 12/2013 |

OTHER PUBLICATIONS

Office Action issued Jan. 5, 2016 in corresponding Japanese Patent Application No. 2013-264778 ( Office, Alexandria, VA (9 pages).

* cited by examiner

*Primary Examiner* — Billy Lactaoen
(74) *Attorney, Agent, or Firm* — Buchanan Ingersoll & Rooney PC

(57) ABSTRACT

An image forming apparatus includes an image forming unit that forms an image on a sheet based on first image data, an image reader that reads a surface of the sheet having the image formed thereon and generates second image data, and a controller that performs detection to detect a defect of the formed image depending on a difference between the first image data and the second image data. The controller analyzes a setting for the sheet or the second image data to determine a sheet color of the sheet and restricts the detection depending on the sheet color.

8 Claims, 6 Drawing Sheets

FIG.3

121

| SHEET TYPE | SHEET COLOR (Rn, Gn, Bn) | SHEET FEEDING TRAY |
|---|---|---|
| A | (200, 216, 230) | 1 |
| B | (196, 200, 230) | 2 |
| C | (230, 240, 235) | 3 |
| ⋮ | ⋮ | ⋮ |

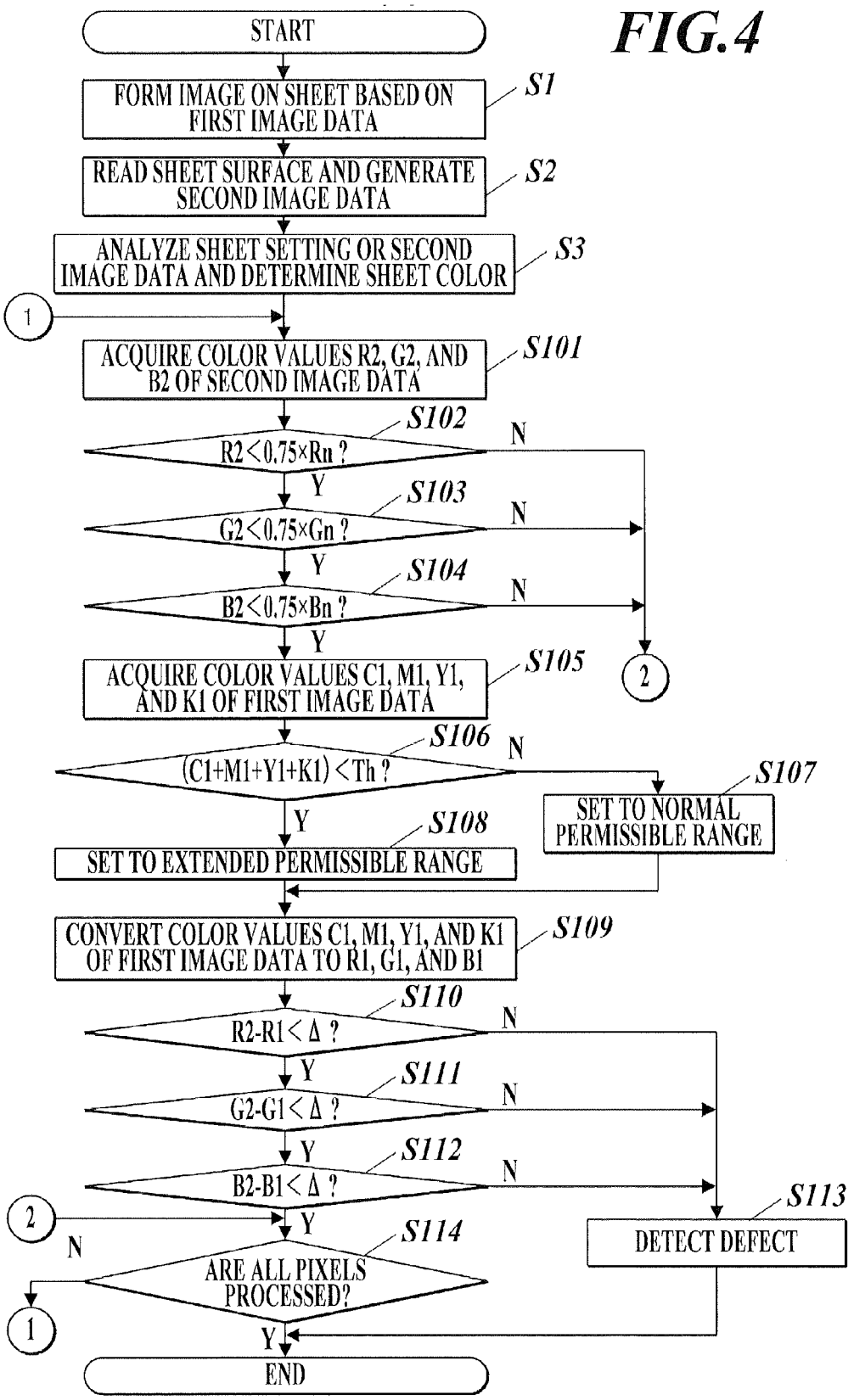
FIG.4
START
FORM IMAGE ON SHEET BASED ON FIRST IMAGE DATA
S1
READ SHEET SURFACE AND GENERATE SECOND IMAGE DATA
S2
ANALYZE SHEET SETTING OR SECOND IMAGE DATA AND DETERMINE SHEET COLOR
S3
1
ACQUIRE COLOR VALUES R2, G2, AND B2 OF SECOND IMAGE DATA
S101
S102
R2<0.75×Rn ?
N
Y
S103
G2<0.75×Gn ?
N
Y
S104
B2<0.75×Bn ?
N
Y
ACQUIRE COLOR VALUES C1, M1, Y1, AND K1 OF FIRST IMAGE DATA
S105
2
S106
(C1+M1+Y1+K1)<Th ?
N
S107
SET TO NORMAL PERMISSIBLE RANGE
Y
S108
SET TO EXTENDED PERMISSIBLE RANGE
CONVERT COLOR VALUES C1, M1, Y1, AND K1 OF FIRST IMAGE DATA TO R1, G1, AND B1
S109
S110
R2-R1<Δ ?
N
Y
S111
G2-G1<Δ ?
N
Y
S112
B2-B1<Δ ?
N
Y
S113
DETECT DEFECT
2
Y
S114
N
ARE ALL PIXELS PROCESSED?
1
Y
END

IMAGE FORMING APPARATUS AND METHOD OF IMAGE INSPECTION TO DETECT IMAGE DEFECT AND SHEET COLOR

BACKGROUND OF THE INVENTION

1. Field of the Invention

The present invention relates to an image forming apparatus and a method for inspecting an image.

2. Description of Related Art

Image forming apparatuses are known that form images on sheets based on image data, inspect the formed images, and then detect defects, such as dust, spattering toner, and color deviation in the images (for examples, see Japanese Patent Application Laid-Open Nos. 2005-205706, 2008-15025, and 2007-310567). Sheets having defective images are ejected as waste sheets into a tray different from the tray for sheets having normal images.

A defect of an image is detected at a time of the image inspection usually by determining whether the difference between the original image data and the image data acquired through reading of the sheet surface is beyond a permissible range.

If the sheet having an image formed thereon is not white but is colored or patterned, the difference between the original image data and the read image data is increased due to the color of the sheet. In such a case, a normal image is easily determined to be a defective image erroneously.

Japanese Patent Application Laid-Open No. 2007-310567 discloses a method of preventing false detection of an image defect formed on a sheet having a preprinted image, such as ruled lines. In this method, the image data with its preprinted image (e.g., ruled lines) masked is compared with the original image data to prevent false detection of a defect.

Such a partial mask, however, could not prevent false detection of an image defect if the whole surface of the sheet is colored or patterned.

SUMMARY OF THE INVENTION

An object of the present invention is to reduce false detection of an image defect caused by a sheet.

To achieve the object, according to a first aspect of a preferred embodiment of the present invention, there is provided an image forming apparatus including: an image forming unit that forms an image on a sheet based on first image data; an image reader that reads a surface of the sheet having the image formed thereon and generates second image data; and a controller that performs detection to detect a defect of the formed image depending on a difference between the first image data and the second image data, wherein the controller analyzes a setting for the sheet or the second image data to determine a sheet color of the sheet and restricts the detection depending on the sheet color.

According to a second aspect of a preferred embodiment of the present invention, there is provided an image forming apparatus including: an image forming unit that forms an image on a sheet based on first image data; an image reader that reads a surface of the sheet having the image formed thereon and generates second image data; and a controller that performs detection to detect a defect of the formed image depending on a difference between the first image data and the second image data, wherein the controller analyzes a setting for the sheet or the second image data to determine a sheet color of the sheet and determines a difference between the second image data and inspection image data created from the first image data in accordance with the sheet color or a difference between the first image data and inspection image data created from the second image data in accordance with the sheet color, to detect the defect.

According to a third aspect of a preferred embodiment of the present invention, there is provided a method of image inspection including: forming an image on a sheet based on first image data; reading a surface of the sheet having the image formed thereon and generating second image data; and performing detection to detect a defect of the formed image depending on a difference between the first image data and the second image data, wherein, in the step of performing the detection, a setting for the sheet or the second image data is analyzed to determine a sheet color of the sheet, and the detection is restricted depending on the sheet color.

According to a fourth aspect of a preferred embodiment of the present invention, there is provided a method of image inspection including: forming an image on a sheet based on first image data; reading a surface of the sheet having the image formed thereon and generating second image data; and performing detection to detect a defect of the formed image depending on a difference between the first image data and the second image data, wherein, in the step of performing the detection, a setting for the sheet or the second image data is analyzed to determine a sheet color of the sheet, and a difference between the second image data and inspection image data created from the first image data in accordance with the sheet color or a difference between the first image data and inspection image data created from the second image data in accordance with the sheet color is determined, for detecting the defect.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein:

FIG. 3 illustrates an example sheet table;

FIG. 4 is a flow chart illustrating another process of inspecting an image by the image forming apparatus according the first embodiment;

DESCRIPTION OF THE PREFERRED EMBODIMENTS

An image forming apparatus and a method for inspecting an image according to embodiments of the present invention will now be described with reference to the accompanying drawings.

First Embodiment

Figure 1:
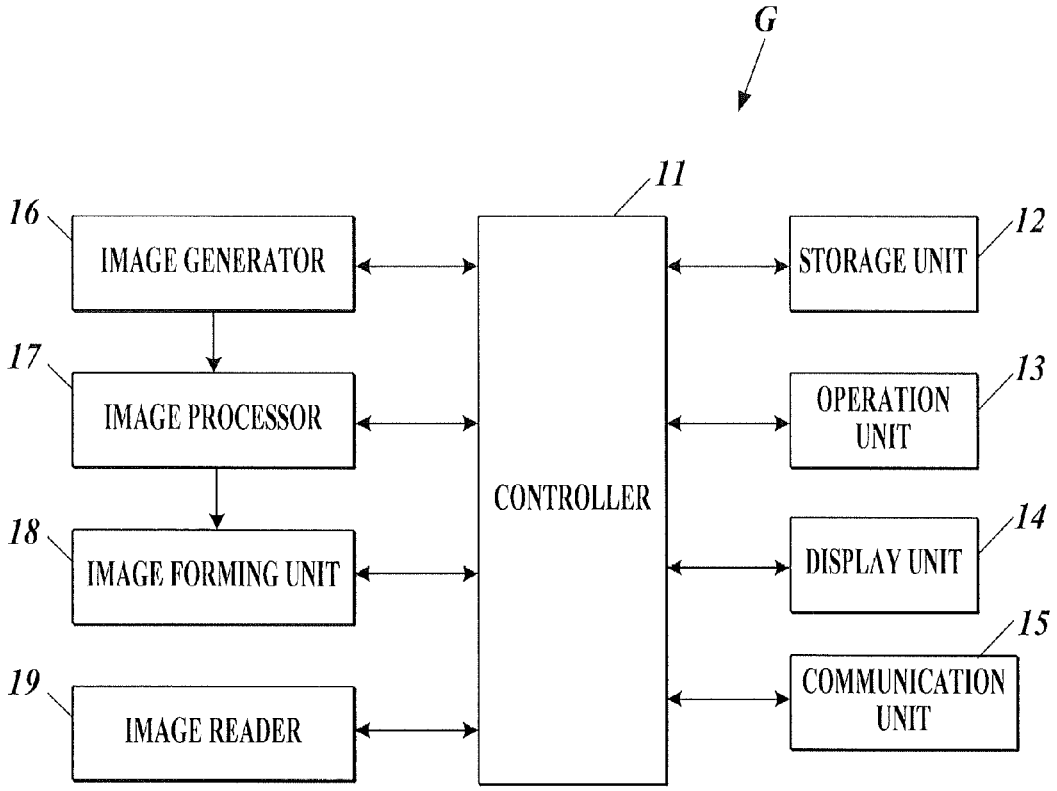
FIG. 1 is a functional block diagram illustrating an image forming apparatus according to an embodiment.

FIG. 1 is a functional block diagram illustrating the functional configuration of an image forming apparatus G according to the first embodiment.

With reference to FIG. 1, the image forming apparatus G includes a controller 11, a storage unit 12, an operation unit 13, a display unit 14, a communication unit 15, an image generator 16, an image processor 17, an image forming unit 18, and an image reader 19.

The controller 11 includes a central processing unit (CPU) and a random access memory (RAM). The controller 11 reads programs stored in the storage unit 12 and controls individual components of the image forming apparatus G in accordance with the programs.

For example, the controller 11 instructs the image processor 17 to process the image data generated by the image generator 16 in accordance with job settings. The job settings are parameters for image formation determined by the user, such as the page for which an image is to be formed, the number of copies to be made, the type and size of the sheet to be used for image formation, and the sheet feeding tray to be used. The controller 11 instructs the image forming unit 18 to form an image on a sheet based on the processed image data.

The controller 11 can inspect the image formed by the image forming unit 18. At the time of such an image inspection, the controller 11 instructs the image reader 19 to read a surface of the sheet having the image formed thereon and generate image data. The controller 11 determines the image to be normal if the difference between the image data input to the image forming unit 18 and the image data generated by the image reader 19 is within a permissible range, whereas the controller 11 detects an image defect if the difference is not within the permissible range.

At the time of such an image inspection, the controller 11 analyzes the setting for sheet or the image data generated by the image reader 19 to determine the color of the sheet and restricts the detection of a defect depending on the sheet color. The "sheet color" is the ground color of the blank sheet before an image is formed thereon.

The storage unit 12 stores programs, files, and other data readable by the controller 11.

For example, the storage unit 12 stores a sheet table in which a sheet color and a sheet feeding tray are associated with each of the sheet types.

The storage unit 12 may be any storage medium, such as a hard disk or a read only memory (ROM).

The operation unit 13 includes operating keys and a touch panel that is integrated with the display unit 14. The operation unit 13 outputs operation signals corresponding to the operation to the controller 11. The user performs input operations, such as the modification of the job settings and the content of processing with the operation unit 13.

The display unit 14 may be any liquid crystal display (LCD) that displays an operating menu and other images in response to instructions from the controller 11.

The communication unit 15 communicates with other computers in the network, such as user terminals, servers, and other image forming apparatuses, in response to instructions from the controller 11. For example, the communication unit 15 receives page description language (PDL) data from a user terminal.

The image generator 16 rasterizes the PDL data received through the communication unit 15 and generates image data corresponding to cyan (C), magenta (M), yellow (Y), and black (K) colors.

The image generator 16 includes a scanner which reads the surfaces of documents fed by a user. The image generator 16 can generate red (R), green (G), and blue (B) image data from the read data from the scanner. The image generator 16 converts the RGB image data into CMYK image data.

The image processor 17 performs gradation correction and halftoning on the CMYK image data generated by the image generator 16.

The gradation correction is a process of correcting the gradation of each pixel of the image data such that the gradation characteristics of the formed image coincide with target gradation characteristics.

The halftoning is, for example, error diffusion or screening using a dithering matrix.

The image forming unit 18 forms an image on a sheet using coloring material, such as toner, on the basis of the CMYK image data input from the image processor 17.

Specifically, the image forming unit 18 includes an exposure unit, a photoreceptor, a developing unit, a sheet feeding tray, a transfer member, and a fixing unit for each of the C, M, Y, and K colors. If the coloring material is toner, the image forming unit 18 instructs the exposure unit to expose the electrically charged photoreceptors with a laser beam modulated based on the image data and instructs the developing unit to supply toners of C, M, Y, and K colors onto the respective photoreceptors on which electrostatic latent images are formed through the exposure. The image forming unit 18 transfers and overlays the color images formed on the photoreceptors through the development onto the transfer member, conveys a sheet from the sheet feeding tray, and transfers the overlaid image from the transfer member onto the sheet. The image forming unit 18 instructs the fixing unit to heat and press the sheet to fix the transferred image onto the sheet.

The image reader 19 reads a surface of the sheet having the image formed thereon at the image forming unit 18.

The image reader 19 may be any color line sensor composed of a one-dimensional array of optic sensors, such as charge coupled devices (CCD).

Figure 2:
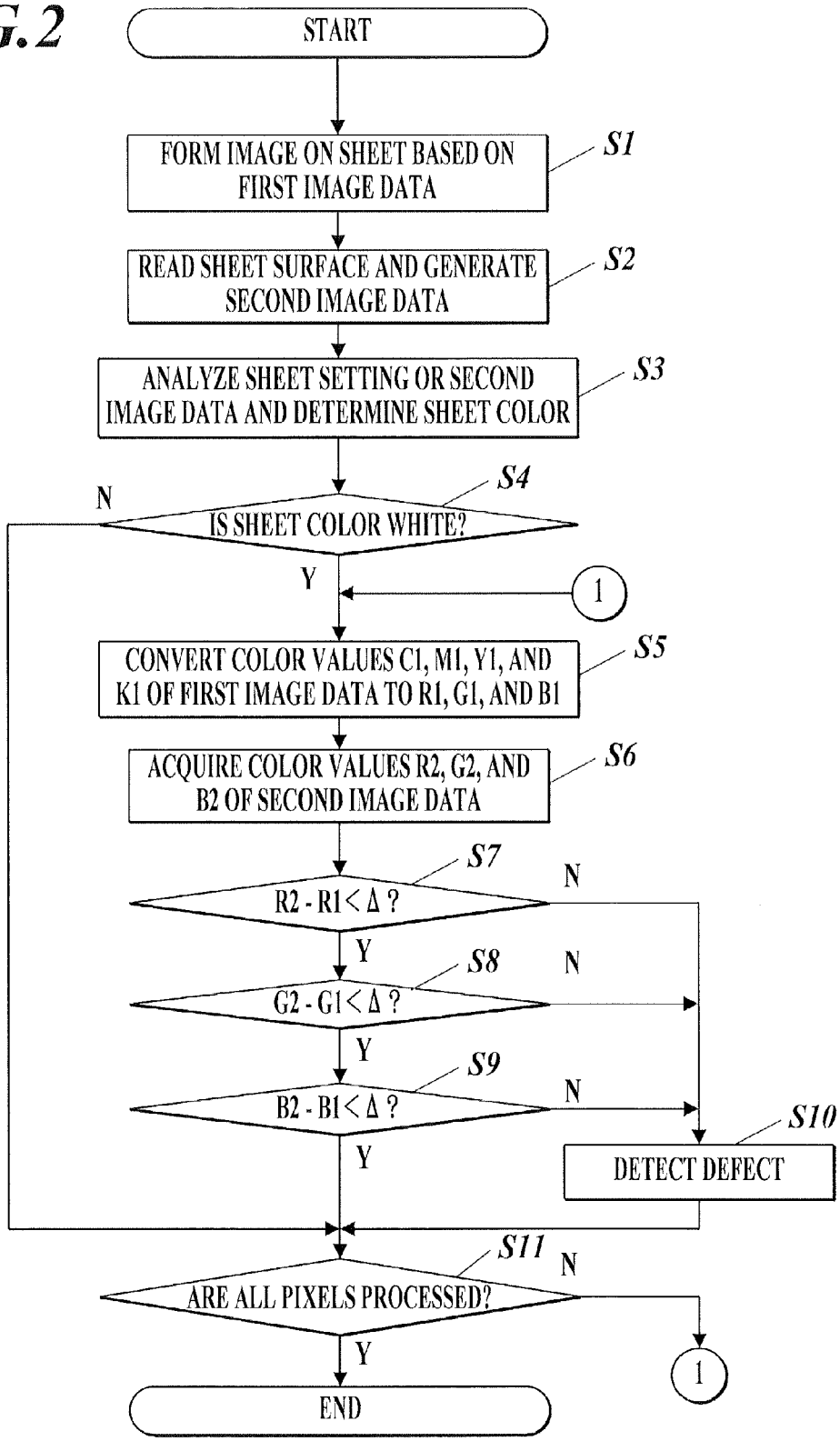
FIG. 2 is a flow chart illustrating the process of inspecting an image by an image forming apparatus according a first embodiment.

FIG. 2 illustrates the process of forming an image and inspecting the image by the image forming apparatus G.

With reference to FIG. 2, the image forming unit 18 of the image forming apparatus G forms an image on a sheet based on input image data (Step S1). The image data input to the image forming unit 18 is referred to as "first image data." The pixels of the first image data have CMYK color values. Smaller CMYK color values represent paler colors.

The image reader 19 then reads a surface of the sheet having the image formed thereon and generates image data (Step S2). The image data generated by the image reader 19 is referred to as "second image data." The pixels of the second image data have RGB color values. Larger RGB color values represent paler colors.

After the generation of the second image data, the controller 11 analyzes the setting for sheet or the second image data and determines the color of the sheet having the image formed thereon (Step S3). The RGB color values of the determined sheet color are denoted by Rn, Gn, and Bn.

In the case of analyzing the setting for sheet, the controller 11 can determine the sheet color with reference to the sheet table stored in the storage unit 12.

FIG. 3 illustrates an example sheet table 121.

With reference to FIG. 3, in the sheet table 121, the color values Rn, Gn, and Bn of a sheet color are associated with each of the sheet types. For the sheets that are stored in sheet feeding trays, the information on sheet feeding tray is further included in association.

The controller 11 acquires, from the sheet table 121, the color values Rn, Gn, and Bn of the sheet color corresponding to the sheet type or the sheet feeding tray included in the job setting.

In the case of analyzing the second image data, the controller 11 can retrieve the RGB color values of non-image areas, such as margins, in the second image data and establish these RGB color values as Rn, Gn, and Bn color values indicating the sheet color.

Alternatively, the controller 11 may determine the sheet color by acquiring, from the sheet table 121, the color values Rn, Gn, and Bn closest to the color values R2, G2, and B2 of the sheet color acquired from the second image data.

After determination of the sheet color, the controller 11 determines whether the sheet is a white sheet based on whether the difference between the determined sheet color and the color of a white sheet is within a predetermined limit (Step S4).

The RGB color values of a white sheet are denoted by R0, G0, and B0. The color values R0, G0, and B0 of a white sheet may be provided in advance or may be acquired by reading a white paper or a white reference board with the image reader 19.

For example, the color values Rn, Gn, and Bn of sheet A, which is the sheet type determined through the analysis of the setting for sheet, are 200, 216, and 230, respectively, according to the sheet table 121, which is illustrated in FIG. 3. If all the color values R0, G0 and B0 of a white sheet are 255, the differences between the color values of the determined sheet color and the color values of a white sheet are 55 (55=255−200) for R, 39 (39=255−216) for 0, and 25 (25=255−230) for B. If the predetermined limit is 20, the controller 11 determines that the sheet is not a white sheet because none of the differences of the color values is within the predetermined limit.

If the sheet is determined to be a white sheet (Y in Step S4), the controller 11 inspects each pixel of the image. An inspection of each pixel is performed preferably after the image is aligned, to prevent false detection of a defect due to misalignment of the image.

For the image inspection, the controller 11 acquires the CMYK color values of one pixel to be inspected (i.e., inspection target pixel) in the first image data. The CMYK color values of the pixel acquired from the first image data are denoted as C1, M1, Y1, and K1.

The controller 11 converts the color values C1, M1, Y1, and K1 to RGB color values (Step S5). The RGB color values of the pixel acquired from the first image data are denoted as R1, G1, and B1.

The controller 11 acquires the RGB color values of the inspection target pixel from the second image data (Step S6). The RGB color values of the pixel acquired from the second image data are denoted as R2, G2, and B2.

The controller 11 then determines the differences (R2−R1), (G2−G1), and (B2−B1) between the color values of the first image data and the color values of the second image data. If any of the differences (R2−R1), (G2−G1), and (B2−B1) is not within a permissible range Δ (N in Steps S7, S8, and/or S9), the controller 11 detects a defect of the image (Step S10).

If a defect of the image is detected, the controller 11 ejects the sheet having the image defect to a catch tray different from a catch tray for sheets having normal images. The process then ends.

If all the differences (R2−R1), (G2−G1), and (B2−B1) are within the permissible range Δ (Y in Steps S7, S8, and S9), the controller 11 determines that the inspected pixel of the image is normal.

The controller 11 returns to Step S5 if there is any pixel that has not been inspected (N in Step S11). Steps S5 to S10 are repeated for the uninspected pixels. Upon completion of the inspection of all pixels (Y in Step S11), the process ends.

If the sheet is determined not to be white (N in Step S4), the controller 11 skips Steps S5 to S10 and goes to Step S11 to disable the detection of an image defect.

The controller 11 returns to Step S5 if there is any pixel that has not been inspected (N in Step S11). Steps S5 to S10 are repeated for the uninspected pixels. Upon completion of the inspection of all pixels (Y in Step S11), the process ends.

The image forming apparatus G according to the first embodiment includes an image forming unit 18 that forms an image on a sheet based on first image data; an image reader 19 that reads a surface of the sheet having the image formed thereon and generates second image data; and a controller 11 that performs detection to detect a defect of the formed image depending on the difference between the first image data and the second image data. The controller 11 analyzes the setting for sheet or the second image data and determines the color of the sheet. If the sheet is not white, the detection of an image defect is disabled to prevent the process for the detection.

This prevents detection of an image defect for non-white sheets and reduces a risk of false detection of an image defect due to the color of the sheet.

Modification 1

Instead of the process described above, the image forming apparatus G may perform the process illustrated in FIG. 4 to restrict the image inspection depending on the sheet color, regardless of whether the sheet is white or not.

In FIG. 4, the steps that are the same as those in FIG. 2 are denoted by the same step numbers.

With reference to FIG. 4, the image forming unit 18 of the image forming apparatus G forms an image on a sheet based on first image data (Step S1).

The image reader 19 then reads a surface of the sheet having the image formed thereon and generates second image data (Step S2).

After the generation of the second image data, the controller 11 analyzes the setting for sheet or the second image data and determines the col or values Rn, Gn, and Rn of the color of the sheet having the image formed thereon (Step S3).

The controller 11 then acquires the color values R2, G2, and B2 of one pixel to be inspected (i.e., inspection target pixel) in the second image data (Step S101).

The controller 11 compares the acquired color values R2, G2, and B2 with 0.75×Rn, 0.75×Gn, and 0.75×Bn, which are thresholds derived from the color values Rn, Gn, and Bn of the sheet color (Steps S102, S103, and S104).

If any of the color values R2, G2, and B2 is equal to or larger than the relevant threshold (N in Steps S102, S103, and/or S104), the controller 11 categorizes the inspection target pixel as a non-target area, and the process then goes to Step S114 to disable the detection of an image defect.

A pixel having color values R2, G2, or B2 equal to or larger than the thresholds has a color similar to the sheet color. Thus, it can be determined that completely or substantially no toner has adhered to the sheet for the inspection target pixel in the image formation. Such a pixel with completely or substantially no toner is easily detected as a defect erroneously because the difference between the first image data and the second image data is large due to the sheet color. Categorizing such a pixel as a non-target area to avoid the process for defect detection can prevent such false detection.

The thresholds 0.75×Rn, 0.75×Gn, and 0.75×Bn are mere examples. The thresholds can be appropriately determined depending on the color values Rn, Gn, and Bn of a sheet color, if these values can be used for the determination of the amount of adhering toner for an inspection target pixel.

Instead of jumping to Step S114 to avoid the detection of a defect, the controller 11 may update all color values of inspection target pixels in the first and second image data to a certain value, for example, zero, and may go to Step S5. If the difference between the first image data and the second image data is zero, no defect is detected in subsequent steps S110 to S112. Thus, the image will always be determined to be normal, and the detection of an image defect is practically disabled.

If all the color values R2, G2, and B2 are smaller than the thresholds (Y in Steps S102, S103, and S104), it is determined that toner has adhered to the sheet for the inspection target pixel in the image formation. The controller 11 categorizes the inspection target pixel as a target area for inspection and acquires the color values C1, M1, Y1, and K1 of the pixel from the first image data (Step S105).

The controller 11 compares the sum of the color values C1, M1, Y1, and K1 (i.e., C1+M1+Y1+K1) with a threshold Th (Step S106).

The threshold Th is used to determine whether the amount of toner to adhere to the sheet is sufficiently large with respect to a sheet color. A normal sheet color has a color value sufficiently smaller than that of the toner, whereas a sheet color having a large color value easily affects the color reproduction of the toner adhering to the sheet. The threshold Th can be determined depending on the color value of the sheet color. If the sum C1+M1+Y1+K1 is equal to or larger than the threshold Th (N in Step S106), it is determined that the amount of toner adhering to the sheet for the inspection target pixel in the image formation is sufficiently large. In such a case, the controller 11 categorizes the inspection target pixel as a normal area for which a defect is detected under a normal condition. The controller 11 sets a permissible range Δ of the difference between the first image data and the second image data to $\Delta_0$, as a normal condition (Step S107).

If the sum C1+M1+Y1+K1 is smaller than the threshold Th (Y in Step S106), it is determined that the amount of toner adhering to the sheet for the inspection target pixel in the image formation is not sufficiently large. In such a case, the controller 11 categorizes the inspection target pixel as a relaxation area for which a defect is detected under a relaxed condition. The controller 11 sets the permissible range Δ, for example, to $3\Delta_0$, which is obtained by extending the normal range $\Delta_0$ (Step S108).

An amount of toner that is not sufficiently large causes a large difference between the first image data and the second image data due to the sheet color. Thus, a defect is erroneously detected easily. An easier condition for defect detection can decrease the frequency of false detection of a defect caused by the sheet color.

After the establishment of the permissible range Δ, the controller 11 converts the color values C1, M1, Y1, and K1 of the first image data to color values R1, G1, and B1 (Step S109).

The controller 11 determines the differences (R2−R1), (G2−G1), and (B2−B1) between the color values R2, G2, and 32 of the second image data and the color values R1, G1, and B1 of the first image data.

The controller 11 determines whether the differences (R2−R1), (G2−G1), and (B2−B1) are within the permissible range A (Steps S110, S111, and S112).

If all the differences (R2−R1), (G2−G1), and (B2−B1) are within the permissible range Δ (Y in Steps S110, S111, and S112), the controller 11 determines that the image is normal for the inspection target pixel.

The controller 11 returns to Step S101 if there is any pixel that has not been inspected (N in Step S114). The process described above is repeated for the uninspected pixels. Upon completion of the inspection of all pixels (Y in Step S114), the process ends.

If any of the differences (R2−R1), (G2−G1), and (B2−B1) is not within the permissible range Δ (N in Step S110, S111, and/or S112), the controller 11 detects a defect of the image (Step S113).

If a defect of the image is detected, the controller 11 ejects the sheet having the image defect to a catch tray different from a catch tray for sheets having normal images. The process then ends.

Through the process described above, the detection of an image defect can be disabled, performed under the normal condition, or performed under the relaxed condition depending on the sheet color. This can reduce the frequency of false detection of a defect due to the sheet.

Second Embodiment

An image forming apparatus according to the second embodiment determines the difference between second image data and inspection image data created from first image data in accordance with the sheet color or the difference between first image data and inspection image data created from second image data in accordance with the sheet color, to detect a defect. This reduces the frequency of false detection of an image defect.

Figure 5:
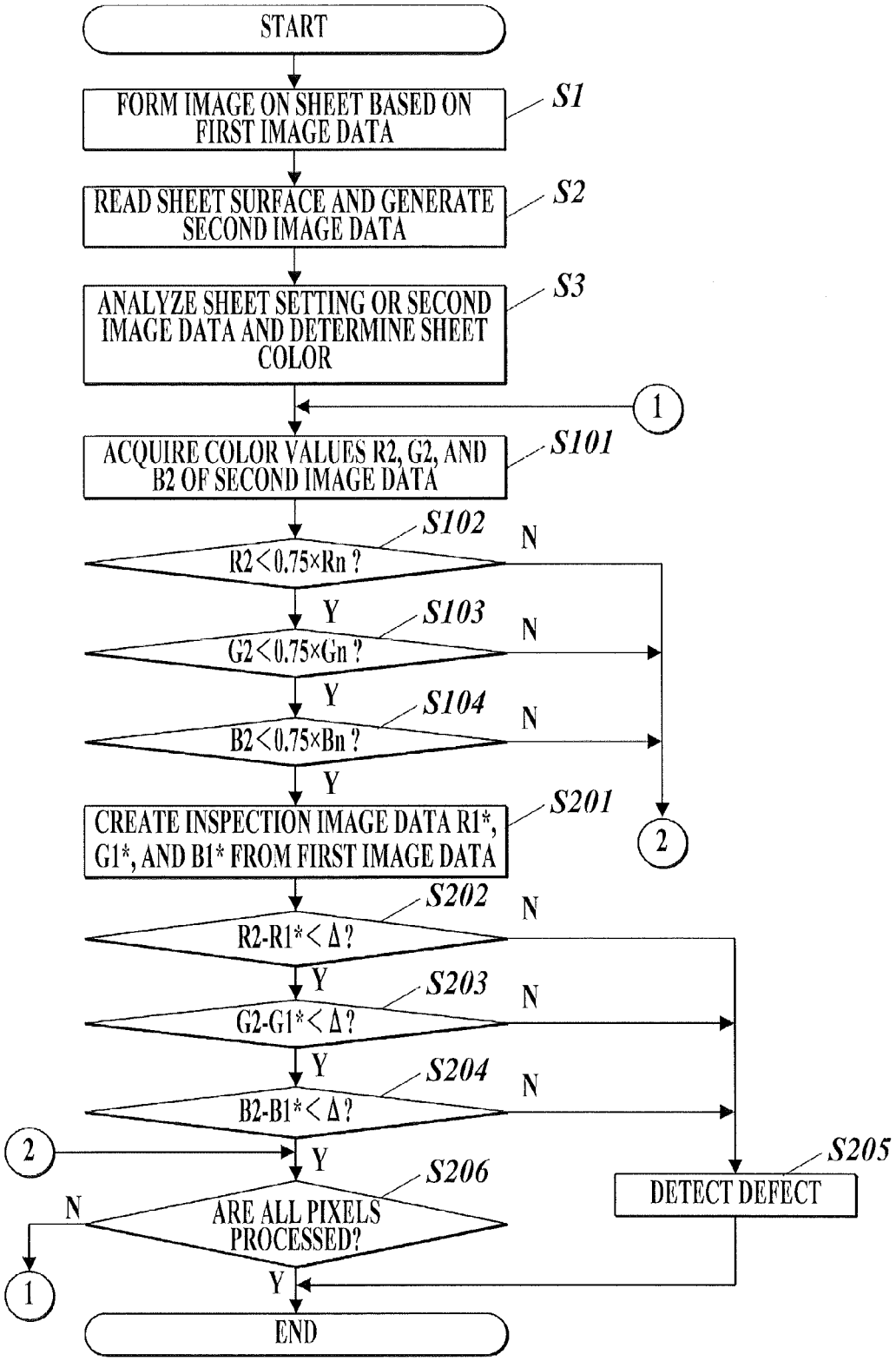
FIG. 5 is a flow chart illustrating the process of inspecting an image by an image forming apparatus according a second embodiment.

The image forming apparatus according to the second embodiment has an identical configuration as that of the image forming apparatus G according to the first embodiment and performs the process illustrated in FIG. 5, instead of the process performed by the image forming apparatus G.

In FIG. 5, the steps that are the same as those in FIG. 4 are denoted by the same step numbers.

With reference to FIG. 5, an image forming unit 18 of the image forming apparatus according to the second embodiment forms an image on a sheet based on first image data (Step S1).

An image reader 19 then reads a surface of the sheet having the image formed thereon and generates second image data (Step S2).

After the generation of the second image data, a controller 11 analyzes the setting for sheet for image formation or the second image data and determines the color of the sheet having the image formed thereon (Step S3).

The controller 11 then acquires the color values R2, G2, and B2 of one pixel to be inspected (i.e., inspection target pixel) from the second image data (Step S101).

The controller 11 compares the acquired color values R2, G2, and B2 with 0.75×Rn, 0.75×Gn, and 0.75×Bn, which are thresholds derived from the color values Rn, Gn, and Bn of the sheet color (Steps S102, S103, and S104).

If any of the color values R2, G2, and B2 is equal to or larger than the relevant threshold (N in Steps S102, S103, and/or S104), the controller 11 categorizes the inspection target pixel as a non-target area, and the process then goes to Step S206 to disable the detection of an image defect.

If all the color values R2, G2, and B2 are smaller than the thresholds (Y in Steps S102, S103, and S104), the controller 11 categorizes the inspection target pixel as a target area for inspection and acquires the color values C1, M1, Y1, and K1 of the pixel from the first image data. The controller 11 then creates inspection image data of the first image data from the acquired color values C1, M1, Y1, and K1 in accordance with the color values Rn, Gn, and Bn of the sheet color (Step S201).

Specifically, the controller 11 creates a gradation conversion table based on the color values Rn, Gn, and Bn of the sheet color and performs gradation conversion of the color values C1, M1, Y1, and K1 of the first image data with reference to the gradation conversion table to acquire color values C1*, M1*, Y1*, and K1* of inspection image data. The controller 11 converts the color values C1*, M1*, Y1*, and K1* of the inspection image data to RGB color values R1*, G1*, and B1*.

Figure 6:
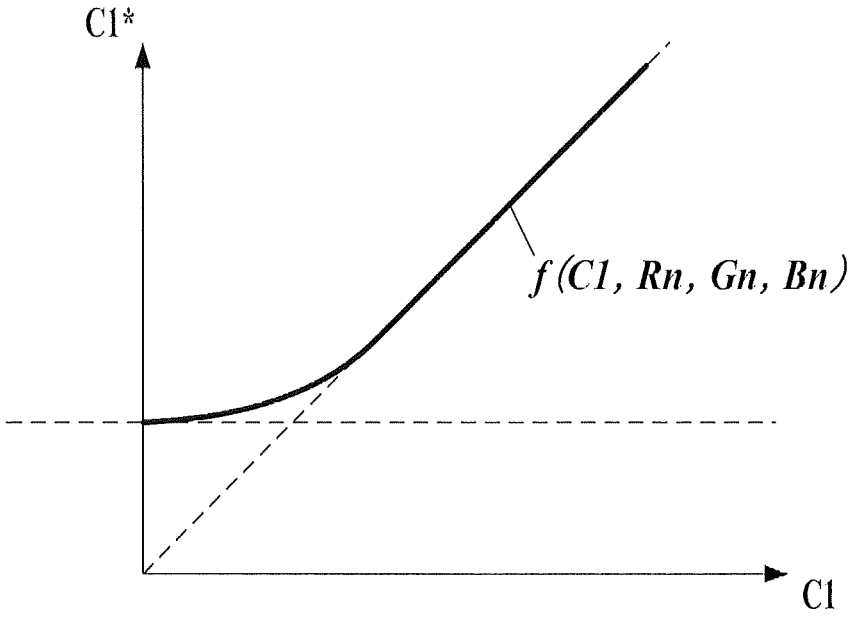
FIG. 6 illustrates an example gradation conversion table.

FIG. 6 illustrates the relationship between an input value C1 and an output value C1* of the color value C1 in the gradation conversion table.

With reference to FIG. 6, the relationship between the input value C1 and the output value C1* can be represented as a function f (C1, Rn, Gn, Bn) to output the value C1* in accordance with the input value C1 and the color values Rn, Gn, and Bn of the sheet color. The first image data has color values smaller than those of the second image data by the color values of the sheet color. Thus, the controller 11 determines the function f (C1, Rn, Gn, Bn) such that the color values of the first image data increase through the gradation convention in accordance with the color values Rn, Gn, and Bn of the sheet color.

FIG. 6 illustrates an example of the color value C1. Gradation conversion tables for the other color values M1, Y1, and K1, which are similar to the gradation conversion table for color value C1, are also created.

The controller 11 determines the differences (R2−R1*), (G2−G1*), and (B2−B1*) between the color values R2, G2, and B2 of the second image data and the color values R1*, G1*, and B1* of the inspection image data.

The controller 11 determines whether the differences (R2−R1*), (G2−G1*), and (B2−B1*) are within the permissible range Δ (Steps S202, S203, and S204).

If all the differences (R2−R1*), (G2−G1*), and (B2−B1*) are within the permissible range Δ (Y in Steps S202, S203, and S204), the controller 11 determines that the image is normal for the inspection target pixel.

The controller 11 returns to Step S101 if there is any pixel that has not been inspected (N in Step S206). The process described above is repeated for the uninspected pixels. Upon completion of the inspection of all pixels (Y in Step S206), the process ends.

If any of the differences (R2−R1*), (G2−G1*), and (B2−B1*) is not within the permissible range Δ (N in Step S202, S203, and/or S204), the controller 11 detects a defect of the image (Step S205).

If a defect of the image is detected, the controller 11 ejects the sheet having the image defect to a catch tray different from a catch tray for sheets having normal images. The process then ends.

The image forming apparatus according to the second embodiment includes an image forming unit 18 that forms an image on a sheet based on first image data; an image reader 19 that reads a surface of the sheet having the image formed thereon and generates second image data; and a controller 11 that performs detection to detect a defect of the formed image depending on the difference between the first image data and the second image data. The controller 11 analyzes the setting for sheet or the second image data to determine the color of the sheet, creates inspection image data from the first image data in accordance with the sheet color, determines the difference between the second image data and the inspection image data, and detects a defect or not depending on the difference.

Such a configuration can reduce the difference between the first image data and the second image data caused by the sheet color to perform the detection of a defect. This reduces the frequency of false detection of a defect due to the sheet.

Modification 2-1

The difference between first image data and inspection image data created from second image data can be determined and a defect can be detected depending on the difference. This can also reduce the frequency of false detection of a defect.

The inspection image data of the second image data can be created through the same process as that described above for the inspection image data of the first image data.

Specifically, the controller 11 creates a gradation conversion table based on the color values Rn, Gn, and Bn of the sheet color. The color values R2, G2, and B2 of the second image data are smaller than the color values of the first image data by the color values of the sheet color. Thus, the controller 11 determines the relationship between input values and output values of the gradation conversion table such that the color values R2, G2, and B2 of the second image data increase through the gradation convention in accordance with the color values Rn, Gn, and Bn of the sheet color.

The controller 11 performs the gradation conversion of the color values R2, G2, and B2 of the second image data with reference to the created gradation conversion table and acquires the color values R2*, G2*, and B2* of inspection image data. The controller 11 converts the color values R2*, G2*, and B2* to CMYK color values C2*, M2*, Y2*, and K2*. The controller 11 detects a defect of the image or not depending on the difference between the color values C2*, M2*, Y2*, and K2* of the inspection image data and the color values C1, M1, Y1, and K1 of the first image data.

Such a configuration can reduce the difference between the first image data and the second image data caused by the sheet color to perform the detection of a defect. This reduces the frequency of false detection of a defect due to the sheet.

Modification 2-2

Whether a sheet is white or not is determined by analyzing the setting for sheet or the second image data and determining the sheet color. If it is determined that the sheet is not white, the process of inspection of the image illustrated in Steps S201 to S206 in FIG. 5 can be performed.

After performing steps S1 to S3 in FIG. 5, the controller 11 determines the sheet color to be white if the difference between the sheet color determined in Step S3 and a white sheet is within a predetermined limit and determines the sheet color to be non-white if the difference is not within the predetermined limit. If the sheet color is white, the controller 11 determines the difference between the second image and inspection image data created from the first image data or determines the difference between the first image data and inspection image data created from the second image data, and then detects a defect or not depending on the difference, in Steps S201 to S206.

Such a configuration can reduce the difference between the first image data and the second image data caused by the sheet color when the sheet color is not white to perform the detection of a defect. This reduces the frequency of false detection of a defect due to the sheet.

The first and second embodiments described above are preferred examples of the present invention. The present invention, however, should not be limited to the embodiments but may be modified appropriately without departing from the scope of the invention.

For example, the first and second embodiments may be combined. For the pixels that are to be inspected and categorized as a relaxation area, a defect may be detected depending on whether the difference between first image data and second image data, obtained with inspection image data, is within an extended permissible range.

The programs carried out by the controller 11 may be stored in a computer-readable medium, such as non-volatile memory, e.g., ROM or flash memory, or a portable recording medium, e.g., CD-ROM. Carrier waves may also be used as a medium for providing the program data via a communication line.

The entire disclosure of Japanese Patent Application No. 2013-264778 filed on Dec. 24, 2013 including description, claims, drawings, and abstract are incorporated herein by reference in its entirety.

Although various exemplary embodiments have been shown and described, the invention is not limited to the embodiments shown. Therefore, the scope of the invention is intended to be limited solely by the scope of the claims that follow.

What is claimed is:

1. An image forming apparatus comprising:

an image forming unit that forms an image on a sheet based on first image data;

an image reader that reads a surface of the sheet having the image formed thereon and generates second image data; and a controller that performs detection to detect a defect of the formed image depending on a difference between the first image data and the second image data, wherein the controller analyzes a setting for the sheet or the second image data to determine a sheet color of the sheet and restricts the detection depending on the sheet color, and wherein the controller categorizes a pixel as a target area or a non-target area for inspection depending on an amount of coloring material adhering to the sheet for the pixel in formation of the image, and the controller disables the detection for the non-target area.

2. The image forming apparatus according to claim 1, wherein the controller compares the second image data with a threshold determined in accordance with the sheet color to determine the amount of the coloring material.

3. The image forming apparatus according to claim 1, wherein the controller categorizes the target area as a normal area or a relaxation area depending on the amount of the coloring material adhering to the sheet for the pixel in the formation of the image, detects the defect under a normal condition for the normal area, and detects the defect under a condition easier than the normal condition for the relaxation area.

4. The image forming apparatus according to claim 3, wherein for the normal area, the controller detects the defect depending on whether the difference between the first image data and the second image data is within a first permissible range; and for the relaxation area, the controller detects the defect depending on whether the difference is within a second permissible range obtained by extending the first permissible range.

5. A method of image inspection comprising:

forming an image on a sheet based on first image data;

reading a surface of the sheet having the image formed thereon and generating second image data; and performing detection to detect a defect of the formed image depending on a difference between the first image data and the second image data, wherein in the step of performing the detection, a setting for the sheet or the second image data is analyzed to determine a sheet color of the sheet, and the detection is restricted depending on the sheet color, and wherein, in the step of performing the detection, a pixel is categorized as a target area or a non-target area for inspection depending on an amount of coloring material adhering to the sheet for the pixel in formation of the image, and the detection is disabled for the non-target area.

6. The method of image inspection according to claim 5, wherein, in the step of performing the detection, the second image data is compared with a threshold determined in accordance with the sheet color to determine the amount of the coloring material.

7. The method of image inspection according to claim 5, wherein, in the step of performing the detection, the target area is categorized as a normal area or a relaxation area depending on the amount of the coloring material adhering to the sheet for the pixel in the formation of the image, the defect is detected under a normal condition for the normal area, and the defect is detected under a condition easier than the normal condition for the relaxation area.

8. The method of image inspection according to claim 7, wherein, in the step of performing the detection, the defect is detected depending on whether the difference between the first image data and the second image data is within a first permissible range for the normal area, and the defect is detected depending on whether the difference is within a second permissible range obtained by extending the first permissible range for the relaxation area.

* * * * *